United States Patent [19]

Skrivanek et al.

[11] 4,080,122

[45] Mar. 21, 1978

[54] DISPLACEMENT PUMP, ESPECIALLY CELL PUMP, FOR COMPRESSING GASEOUS MEDIA

[75] Inventors: Karl Skrivanek; Arnold Witt, both of Oberursel, Germany

[73] Assignee: Klockner-Humboldt-Deutz Aktiengesellschaft, Cologne, Germany

[21] Appl. No.: 593,717

[22] Filed: Jul. 7, 1975 (Under 37 CFR 1.47)

[30] Foreign Application Priority Data

Jul. 6, 1974 Germany ..... 2432621

[51] Int. Cl.[2] ..... F04C 29/00

[52] U.S. Cl. ..... 418/178; 418/81

[58] Field of Search ..... 418/75, 76, 77, 78, 418/79, 80, 81, 178, 179, 266, 133

[56] References Cited

U.S. PATENT DOCUMENTS

| | | | |
|---|---|---|---|
| 845,114 | 2/1907 | Palmer | 418/76 |
| 1,676,103 | 7/1928 | Mason | 418/81 |
| 2,312,655 | 3/1943 | Lauck | 418/179 X |
| 3,191,503 | 6/1965 | Fuehrer | 418/266 |
| 3,552,895 | 1/1971 | Bayley | 418/178 |
| 3,705,818 | 12/1972 | Grosseau | 418/178 X |

FOREIGN PATENT DOCUMENTS

| | | | |
|---|---|---|---|
| 237,596 | 11/1925 | United Kingdom | 418/179 |

*Primary Examiner*—William L. Freeh
*Assistant Examiner*—Leonard Smith
*Attorney, Agent, or Firm*—Walter Becker

[57] ABSTRACT

A displacement pump, especially cell pump for high speeds, for compressing gaseous media, which includes a housing in which a rotatable body is journaled having slides radially movably guided therein. The bearings for the rotatable body are radially guiding loose bearings with oil lubrication. Between the bearings for the rotatable body and in the rotatable body there are provided radially slidable discs with spiral grooves. The slides and the housing and/or a cylinder inserted into said housing are made of steel, and the inner wall surface of the housing or of the cylinder forms a smooth sliding surface for the slides.

1 Claim, 2 Drawing Figures

DISPLACEMENT PUMP, ESPECIALLY CELL PUMP, FOR COMPRESSING GASEOUS MEDIA

The present invention relates to a displacement pump, especially cell pump for very high speeds, for compressing gaseous media, with a body of rotation which is journaled in a housing in which slides are radially movably guided, said slides resting against an inner wall of the housing.

With a high speed transmission for airplanes of high speeds, which transmission is also called an auxiliary gear box, a compressed air pump is required which at high altitudes up to 20,000 meters will assure that in the inner chamber of the transmission, for purposes of avoiding cavitations and oil foam, there will prevail a sufficiently high air pressure. For purposes of generating this air pressure, a cell pump is installed in the gear box, which pump, in order to avoid stepdowns, rotates with the speed of the transmission, approximately 13,000 revolutions per minute. Cell pumps of customary design will at the required temperatures of operation of from −40° to +135° C. not be satisfactory at all with regard to wear and safety of operation.

Therefore, it is an object of the present invention to solve these problems and so to improve a cell pump that it will be simple in construction, can easily be manufactured, and will be light in weight, while nevertheless, it will assure a long life and safety.

These objects and other objects and advantages of the invention will appear more clearly from the following specification, in connection with the accompanying drawing, in which.

The displacement pump according to the present invention, is characterized primarily in that the bearings for the body of rotation are formed by radially guiding loose bearings with oil lubrication. Furthermore, on both sides of the body of rotation, there are provided stationary discs which have spiral grooves and which axially guide the end faces of the body of rotation or the slide. Furthermore, the slides and the housing or a cylinder inserted into the housing are made of steel while the housing or inner cylinder inner wall has undergone a suitable surface treatment.

A cell pump provided with the above mentioned features is able to meet the high requirements of operation. While fundamentally spiral grooves - disc bearings are known, their action is based on the physical finding that at the edges between the elevations and depressions a flow pressure occurs during the relative movement to which end customarily sufficient lubricants are made available at the respective areas. Therefore, it was not obvious to employ such spiral groove disc bearings with an air-conveying cell pump, particularly inasmuch as such cell pump works with the exception of minor bearing lubrication, without lubrication. Also, a different journaling of the body of rotation, for instance, by a fixed bearing with the oil lubrication brought about no satisfactory results as to wear and life to the pump. By employing the features according to the invention, however, the seizing behavior was avoided and a long lifetime was obtained. This appears to be due to the fact that now the spiral groove disc bearings also in combination with the slides not only act as axial bearings, but additionally have a pumping effect whereby air as well as oil present at the bearings is pumped along the radial side surfaces and the housing inner wall. Also, the suitable surface treatment of the housing inner wall or cylinder inner wall is of considerable importance in this connection. As particularly favorable surface treatment, a currentless nickel plating according to the Kanisil method has proved highly favorable. The overall effect has furthermore been aided by the fact that the discs containing the spiral grooves extend up to the housing inner wall or cylinder inner wall while at the inner radius they are spaced from the body of rotation and there form an annular gap. With a cell pump in which the housing is made of a light metal alloy, it is advantageous that the loose bearings (Loslager) are cylindrical roller bearings, the bearing outer rings of which, are arranged in the housing with bushings therebetween. These bushings and said discs form one piece with each other, however, also pressed-in bushings for receiving the bearings and loose suitably secured discs may be employed.

Figure 1:
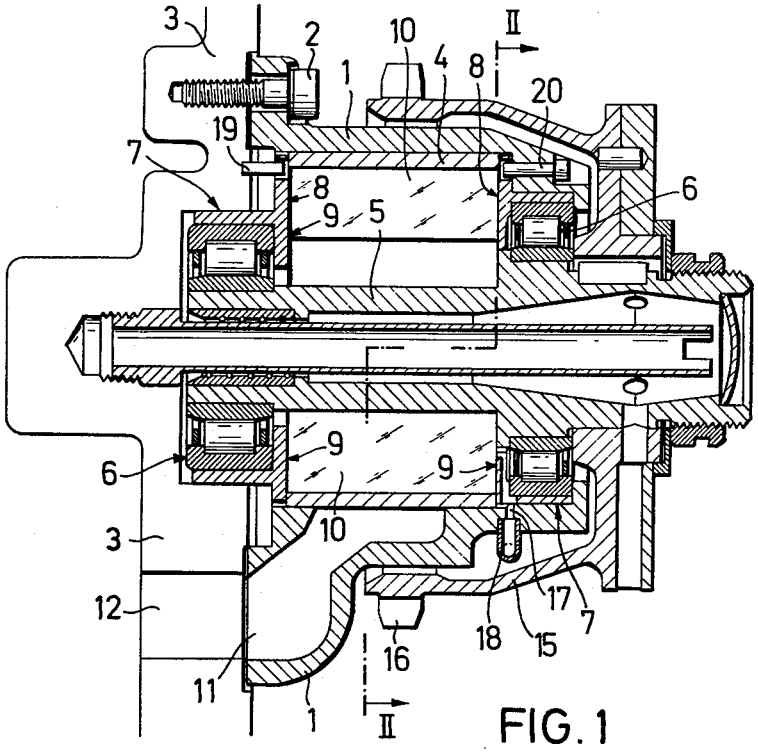
FIG. 1 is a longitudinal section through a cell pump according to the invention.
Figure 2:
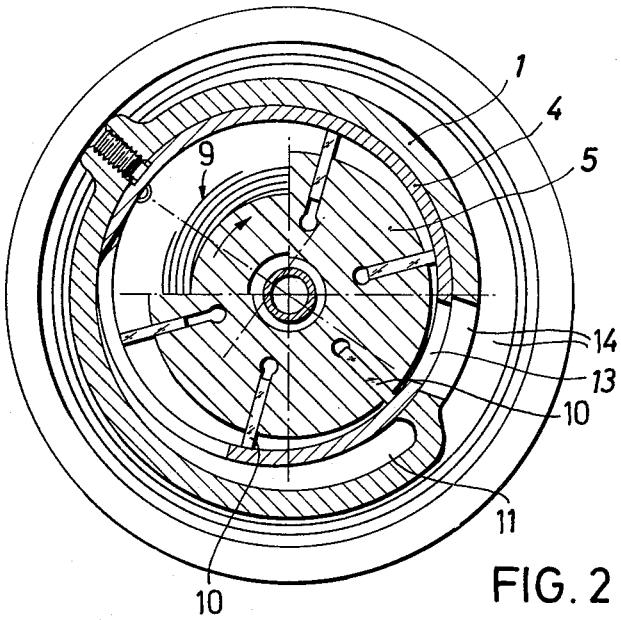
FIG. 2 represents a section taken along the line II—II of FIG. 1 while the left-hand upper section illustrates that portion which is above the center line.

Referring now to the drawings in detail, FIGS. 1 and 2 show a housing 1 which is made of a light metal alloy and which by means of screws 2 is connected to a wall 3 of a gear box, not illustrated in detail. Inserted into the housing 1 is a cylinder 4 which serves as sliding surface for the slides 10 which will be described in detail herebelow. The inner surface of the cylinder is, for improving its sliding properties, nickel plated in a currentless manner in conformity with the Kanisil method. Within the housing there is provided a body of rotation 5 which simultaneously is designed as shaft and is journaled in cylindrical roller bearings 6. The outer rims of the cylindrical roller bearings are inserted in bushings 7 which, in their turn, are arranged in the housing 1 or in the wall 3. Between the bearings 6 and the body of rotation 5 there are inserted discs 8 which form one piece with the bushings 7. The discs 8 extend primarily over the entire radial extension between the range of the shaft of the body of rotation 5 up to the inner wall of the cylinder 4. However, between the range of the shaft of the body of rotation 5 and the discs 8 there is provided an annular gap. The discs 8 have at that side thereof which faces the body of rotation 5 spiral grooves 9 within their inner region, which grooves are particularly clearly shown in FIG. 2. The body of rotation 5 is, in customary manner, provided with radial slots in which slides 10 of steel are provided. Furthermore, the body of rotation is, in customary manner, journaled eccentrically with regard to the housing 1 or the cylinder 4 so that by increasing or decreasing the chambers between the discs, and the free slot space at the inner ends of slides 10, a pumping effect is created. To this end, the housing 1 has an intake passage 11 which communicates with a bore 12 in wall 3 through which the pump can draw in air. As has furthermore been illustrated in FIG. 2, the cylinder 4 has an opening 13 which communicates with a compressed air exit passage 14. The drive of the body of rotation 5 is effected by a bell-shaped hub 15 equipped with a gear ring 16. Both cylindrical roller bearings 6 are provided with oil for lubricating purposes as indicated in connection with the right-hand bearing in FIG. 1 by the bore 17 and the conduit 18. The discs 8 are by pins 19 and screws 20 firmly connected to the housing 1 or wall 3 for preventing a turning of discs 8. The axial distance between the discs 8 is somewhat greater than the width of the body of rotation 5 and of the wings 10 so that during the operation of the cell pump, pressure builds up between these elements and takes over the axial guiding of the body of rotation. The pressure is increased as soon as the distance decreases so that an exact guiding is effected in conformity with the conditions of force. Due to the rotation of the wings and of the body of rotation in cooperation with the spiral grooves, an oil and air mixture is pumped along the disc toward the outside and also passes between the slides 10 and the cylinder 4 so that a safe operation and a sufficiently long life of the pump will be assured.

It is, of course, to be understood that the present invention is, by no means, limited to the specific showing in the drawing, but also comprises any modifications within the scope of the appended claims. In this connection, it may also be mentioned that the features of the invention can correspondingly also be applied to other pumps.

What we claim is:

1. A displacement pump for instance a cell pump for very high speeds, for compressing gaseous media, which includes: housing means of light metal alloy including steel cylindrical inner wall means installed therein, a rotatable body arranged in said housing means and eccentrically surrounded by said cylindrical inner wall means, a plurality of steel sliding members radially slidably guided by and radially movable as guided in said rotatable body and having their radially outer ends arranged for sliding engagement with said cylindrical inner wall means, and a plurality of stationary discs arranged on opposite sides of said rotatable body relative to said sliding members so as to confine the same in the axial direction of said rotatable body, the improvement in combination therewith comprising:

a. radially guiding loose bearing means with oil lubrication arranged within said housing means for supporting said rotatable body, b. said stationary discs extending up to the inner wall means of said housing means and together with an adjacent portion of said body of rotation forming an annular gap, c. said cylindrical inner wall means being nickel-plated in a currentless manner, said loose bearing means being cylindrical roller bearings having outer ring means, bushing means arranged in said housing means by the outer ring means and forming one piece with said stationary discs as arranged in said housing means and holding said roller bearings in said housing means.

* * * * *